US005881566A

United States Patent [19]

Shacklock et al.

[11] Patent Number: 5,881,566

[45] Date of Patent: Mar. 16, 1999

[54] EVAPORATION DEVICE FOR REFRIGERATION EQUIPMENT

[75] Inventors: Anthony John Shacklock; Keith Brookes Spong, both of Auckland, New Zealand

[73] Assignee: Fisher & Paykel Limited, Auckland, New Zealand

[21] Appl. No.: 842,416

[22] Filed: Apr. 24, 1997

[30] Foreign Application Priority Data

Apr. 26, 1996 [NZ] New Zealand ..... 286458

[51] Int. Cl.[6] ..... F25B 47/00

[52] U.S. Cl. ..... 62/277; 62/279; 62/286; 165/46; 165/DIG. 47

[58] Field of Search ..... 62/272, 277, 279, 62/285, 286, 305; 165/46, DIG. 44, DIG. 47, DIG. 48, DIG. 49

[56] References Cited

U.S. PATENT DOCUMENTS

| | | | |
|---|---|---|---|
| 2,626,509 | 1/1953 | Morrison | 62/279 |
| 2,758,449 | 8/1956 | Wallenbrock | 62/279 |
| 2,909,907 | 10/1959 | Swanson | 62/279 |
| 4,155,402 | 5/1979 | Just | 165/46 |
| 4,497,183 | 2/1985 | Gelbard et al. | 62/295 |
| 4,938,279 | 7/1990 | Betker | 165/46 |
| 5,000,256 | 3/1991 | Tousignant | 165/46 |

FOREIGN PATENT DOCUMENTS

| | | | |
|---|---|---|---|
| 405039977 | 2/1993 | Japan | 62/277 |
| 406117747 | 4/1994 | Japan | 62/277 |

*Primary Examiner*—William Doerrler
*Attorney, Agent, or Firm*—Trexler, Bushnell, Giangiorgi & Blackstone, Ltd.

[57] ABSTRACT

An evaporation tray for a refrigerator or refrigerator/freezer which is adapted in use to contact a heat producing part of the refrigeration system (such as the compressor or condenser). The tray comprises a rigid frame which supports a flexible membrane designed to receive defrost liquid from the refrigerator or refrigerator/freezer. The frame is designed to sit adjacent the heat producing part so that the flexible membrane is in direct contact with the heat producing part. As the membrane is flexible, it easily deforms to the shape of the heat producing part providing increased heat transfer to liquid in the tray.

16 Claims, 4 Drawing Sheets

EVAPORATION DEVICE FOR REFRIGERATION EQUIPMENT

BACKGROUND OF THE INVENTION

1. Field of the Invention

This invention relates to refrigerating and/or freezing equipment and more particularly, though not solely, to equipment used to collect and evaporate surplus (defrost) liquid water produced by refrigeration equipment.

2. Description of the Prior Art

During the operation of refrigerating or freezing equipment (which henceforth will be generally referred to as refrigeration equipment), water (present in the form of water vapour in the air within the various compartments of the refrigeration equipment) condenses on the refrigeration equipment's cooling surfaces and is then cooled to produce ice. Eventually, the amount of ice built up on the cooling surfaces (evaporator) becomes a hindrance to the efficient operation of the cooling mechanism and may also cause structural damage due to the expansion (upon cooling) of condensed water which may have found its way into narrow gaps in the refrigeration equipment.

In order to remove ice and liquid water from the refrigeration equipment, most refrigerators and freezers regularly, or upon instruction (for example from an operator or under software control) carry out a defrost cycle in which heat is introduced into the refrigeration equipment (from a heater element or the like) in order to melt any built up ice. The liquid thus formed (defrost liquid) may then be directed out of the various compartments of the refrigeration equipment under the influence of gravity through a system of channels and passageways. In many cases, the defrost liquid is fed to a container to be emptied by a user or alternatively, the container may be positioned adjacent to the compressor of the refrigeration equipment so that the heat produced during the normal operation of the compressor may be beneficially utilised to evaporate the defrost liquid away. In the latter embodiment, the container is called an "evaporation tray" and is usually positioned atop the compressor to take full advantage of heat conducted through the compressor housing and convected heat carried by air passing around and over the compressor.

Conventional evaporation trays are made from a solid, inflexible plastics or metal material in the shape of a comparatively short (vertically) rectangular, open topped box. The base of the tray has, in recent times, been shaped so as to accommodate the top of the compressor in an efficient heat transfer relationship. Many compressor housings have a convex shaped top and the base of the matching evaporation trays are therefore formed with a curved section to allow the tray to contact the top of the compressor over a surface area which is as large as possible. In this way heat transfer and thus the volume of water which may be evaporated from the evaporation tray in a given time are maximised. However, the thickness of the evaporation tray reduces the amount of heat transferred from the compressor as do any air gaps formed when the evaporation tray is not in contact with the compressor housing. It has been found that the volume of water arriving at the evaporation tray varies considerably with time. During defrosting, a large volume of water arrives at the evaporation tray in a short period of time whereas during the normal operation of the refrigeration device, where the only cause of defrosting is the introduction of warm air to the compartments by the opening of a door, very little water arrives at the evaporation tray over a significantly longer period of time. In addition, when the refrigeration equipment is installed in regions of high ambient humidity, the evaporation rate from existing evaporation trays is often less than the rate of defrost liquid production. Accordingly, the evaporation tray has been required to accommodate (and attempt to evaporate as quickly as possible) a large influx of water without overflowing.

One attempt to resolve this problem has been by the introduction of a secondary "overflow" evaporation tray which receives the overflow from the main tray atop the compressor. This setup is however undesirable as it requires extra hardware and is therefore costly. Furthermore it would be desirable to be able to produce only one model of evaporator tray in a variety of refrigeration equipment models. This is presently not possible while maintaining the required heat transfer. It would also be beneficial if the evaporation tray could be reduced in volume as this could mean a reduction in the overall volume of the refrigeration equipment set aside for the compressor could be achieved, allowing an increase in the useable cooling space within the refrigeration equipment. However, presently available evaporation trays are unable to quickly evaporate the defrost water and accordingly, must be capable of storing a large quantity of defrost water so that it may be evaporated over a comparatively longer period of time. An easily removable evaporation tray would also be desirable as it would allow the user to simply remove the tray for regular cleaning.

It is, therefore, an object of the present invention to provide liquid collection and evaporation means for refrigeration equipment which goes some way towards overcoming the above disadvantages or which will at least provide the industry with a useful choice.

Accordingly, in one aspect, the invention consists in liquid collection and evaporation means for refrigeration equipment adapted to collect liquid produced during the operation of said refrigeration equipment, said refrigeration equipment having a heat producing means with a heated surface, said liquid collection and evaporation means comprising:

- substantially rigid frame means adapted for positioning adjacent said heated surface and forming a peripheral support which defines at least the extremities of a substantially horizontal opening, and
- flexible tray forming membrane means suspended at its periphery from said peripheral support, enclosing the space below said opening, said membrane assuming a tray shape capable of holding at least a predetermined volume of said liquid and adapted to contact and deform to the shape of said heated surface to enable heat to pass there through to evaporate said liquid.

In a second aspect, the invention consists in refrigeration equipment comprising:

- a refrigeration system which, when operational extracts heat from within said refrigeration equipment, including a heat producing means which upon energisation produces heat, said heat producing means having a surface which is heated by at least some of said heat produced by said heat producing means,
- cabinet means containing at least one cooling compartment which is cooled due to the operation of said refrigeration system, said at least one cooling compartment on occasion producing a liquid flow due to the operation of said refrigeration system,
- liquid channelling means which collect said liquid flow from within said at least one compartment and direct said liquid flow outside said at least one cooling compartment, said liquid channeling means having an outlet outside said compartment through which collected said liquid flow is directed substantially rigid frame means adapted positioned adjacent said heated surface of said heat producing means, and flexible tray forming membrane means suspended at its periphery from said peripheral support, enclosing the space below said opening, said membrane assuming a tray shape capable of holding at least a predetermined volume of said liquid and adapted to contact and deform to the shape of said heated surface to enable heat to pass there through to evaporate said liquid.

BRIEF DESCRIPTION OF THE DRAWINGS

One preferred form of the present invention will now be described with reference to the accompanying drawings in which.

DETAILED DESCRIPTION OF THE PREFERRED EMBODIMENT

Figure 4:
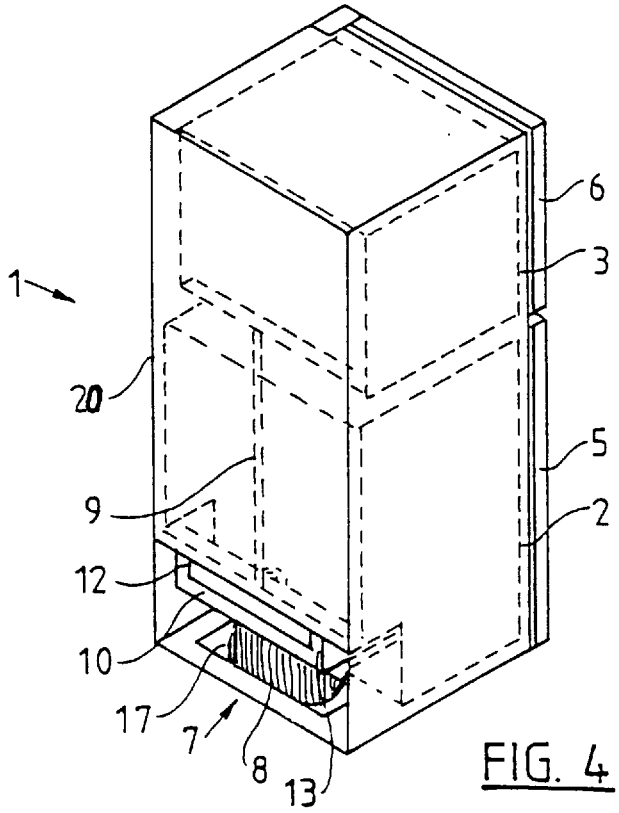
FIG. 4 is a perspective view of a refrigerator including the evaporator of FIG. 1.

With reference to the drawings and in particular FIG. 4, refrigeration equipment, for example a refrigerator/freezer 1 includes a cabinet 20 enclosing at least one cooling compartment, for example a produce compartment 2 and a freezer compartment 3. Each of the cooling compartments (2 and 3) are provided with doors (5 and 6 respectively) to allow a user to add or extract items of food or produce which are to be cooled. A refrigeration system 7 includes a compressor 8, which is fitted externally to the cooling compartments of the refrigerator/freezer 1. The compressor 8 pumps refrigerant through at least one evaporator plate within the cooling compartments in the known way resulting in the cooling of the evaporator thus cooling the compartments 2 and 3. The refrigeration system 7 also includes a condenser 17 which dissipates heat extracted from the compartments.

During the operation of the refrigeration system 7 (which is controlled by a microcontroller or microprocessor or other suitable hardware), the compressor 8 is occasionally energised, cooling the at least one evaporator plate, reducing the temperature of the surface of and air within the compartments. As a result, water vapour from the air within the cooling compartments condenses on the cool surfaces within the compartments which, if further cooled, eventually turns to ice. In addition to the beneficial work done by the compressor in pumping refrigerant, heat is also produced which warms the outer surface of the compressor housing. Due to the operation of compressor 8, condenser 17, which liquefies and cools high temperature gaseous refrigerant, is also heated.

In a third aspect, the liquid collection and evaporation means for refrigeration equipment is adapted to collect liquid produced during the operation of the refrigeration equipment. The refrigeration equipment has a heat producing means with a heated surface. The liquid collection and evaporation means includes a first supporting frame means adapted for attachment to the refrigeration equipment adjacent the heat producing means, and a second interconnecting membrane supporting means removably supported on the first supporting frame means, the first supporting frame means and the second interconnecting membrane supporting means together forming a substantially rigid frame means, and a flexible tray forming membrane means suspended from the second interconnecting membrane supporting means, which forms a tray shape capable of holding at least a predetermined volume of the liquid and adapted to contact and deform to the shape of the heated surface to enable heat to pass there through to evaporate the liquid.

In a fourth aspect, the refrigeration equipment includes a refrigeration system which, when operational extracts heat from within the refrigeration equipment, including a heat producing means which upon energisation produces heat, the heat producing means having a surface which is heated by at least some of the heat produced by the heat producing means, cabinet means containing at least one cooling compartment which is cooled due to the operation of the refrigeration system, the at least one cooling compartment on occasion producing a liquid flow due to the operation of the refrigeration system, liquid channeling means which collect the liquid flow from within the at least one compartment and direct the liquid flow outside the at least one cooling compartment, the liquid channeling means having an outlet outside the compartment through which collected the liquid flow is directed and liquid collection and evaporation means having a first supporting frame means adapted for attachment to the refrigeration equipment adjacent the heat producing means, and a second interconnecting membrane supporting means removably supported on the first supporting frame means, the first supporting frame means and the second interconnecting membrane supporting means together forming a substantially rigid frame, and a flexible tray forming membrane means suspended from the second interconnecting membrane supporting means, which forms a tray shape held in position by the second interconnecting membrane supporting means to receive liquid discharged from the outlet and capable of holding at least a predetermined volume of the liquid, the membrane means contacting the heated surface and conforming to the shape thereof to enable hat to pass there through to evaporate the liquid.

In order to remove any built up ice from within the cooling compartments, the controller occasionally runs through a defrost routine in which heat is introduced to the compartments 2 and 3. By way of example, a radiative heater could be used to introduce heat to the compartments and preferably the heat is directed towards the evaporator plate as this is the source of most ice build up. As a result of the introduction of heat, the built up ice is melted, producing a liquid flow of "defrost liquid" (mostly water) which must be drained. A series of passageways and channels 9 within the refrigerator 1 remove the defrost liquid under the influence of gravity. The series of passageways and channels 9 deliver the defrost liquid outside the cooling compartments 2 and 3 to a liquid collection and evaporation means for disposal (evaporation), for example evaporation tray 10 which is constructed (as detailed below) in accordance with the preferred embodiment of the present invention.

Figure 2:
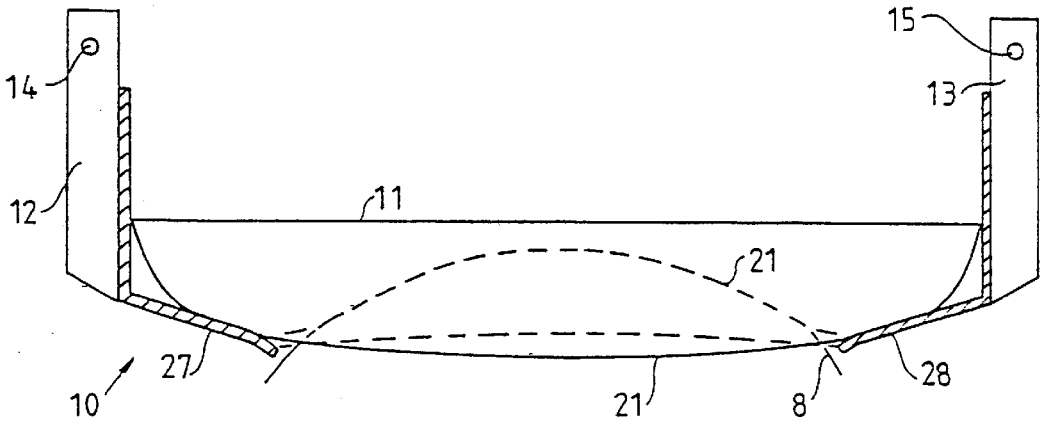
FIG. 2 is a sectional front elevation of the evaporation tray of FIG. 1 through the dash-dot line marked A—A in FIG. 1.
Figure 1:
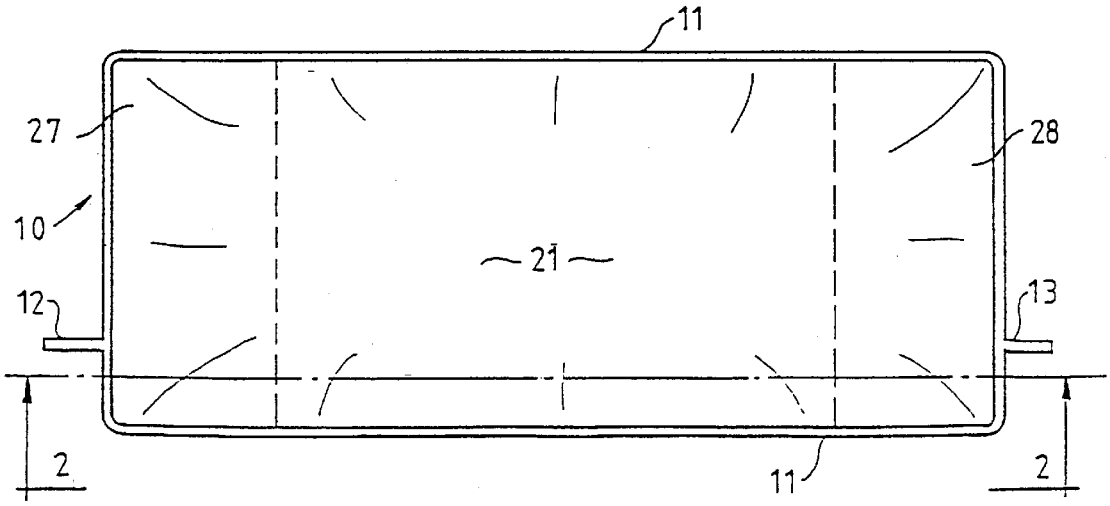
FIG. 1 is a plan elevation of an evaporation tray constructed in accordance with the preferred embodiment of the present invention.
Figure 3:
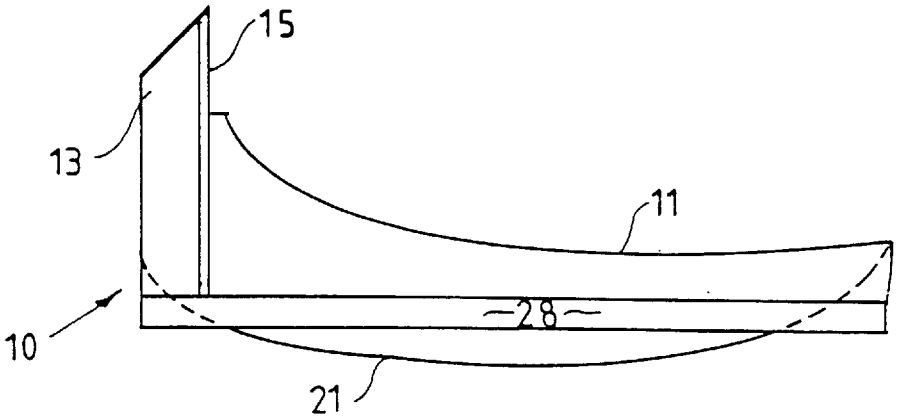
FIG. 3 is a side elevation of the refrigeration tray of FIG. 1.

Referring now to FIGS. 1, 2 and 3, the preferred evaporation tray 10 constructed in accordance with the present invention is shown. The preferred evaporation tray is constructed from two materials having differing structural properties. The first material is substantially rigid and provides structural support to the tray. The rigid material may be, for example, a tough thermosetting plastic which is used to construct a substantially rigid frame means, for example box frame 11 which, at least in the preferred form comprises a substantially rectangular box-like structure having opposed open ends and enclosed sides. In order to fix the evaporation tray 10 to the refrigerator 1, attachment means 12 and 13 are provided on box member 11 so that the evaporation tray may be for example hung from the refrigerator cabinet 20 by the means of screws passed through holes 14 and 15.

The second material used in the construction of the preferred evaporation tray is a more flexible material, preferably a polymeric material such as a thin plastics or rubber sheet material such as is used in plastic bag construction. This more flexible and deformable material is used as a flexible tray forming membrane or container membrane 21. In the preferred form the container membrane 21 comprises a rectangular sheet of plastic sheet which is attached around the perimeter of box frame 11, preferably being attached along top edge 22. In order to assist in supporting container membrane 21 and defrost liquid within container membrane 21, base plates 27 and 28 are attached at a sloping angle to box frame 11 with a gap there between through which container membrane 21 may protrude. In an alternative embodiment shown in FIG. 6, box frame 11 may effectively be split in two interconnecting sections, a first supporting frame means section 24 (which also provides attachment means 12 and 13) and a second interconnecting membrane support means section 25, (which has the container membrane 21 attached thereto) which when connected form join line 23. To part the two sections, membrane support means section 25 is lifted away from support frame means section 24 in the direction of arrow 26. This alternative embodiment may be useful to allow a user to wash the container membrane 21 (should it be required) while allowing the support frame means section 24 to remain connected to the refrigeration equipment.

Figure 5:
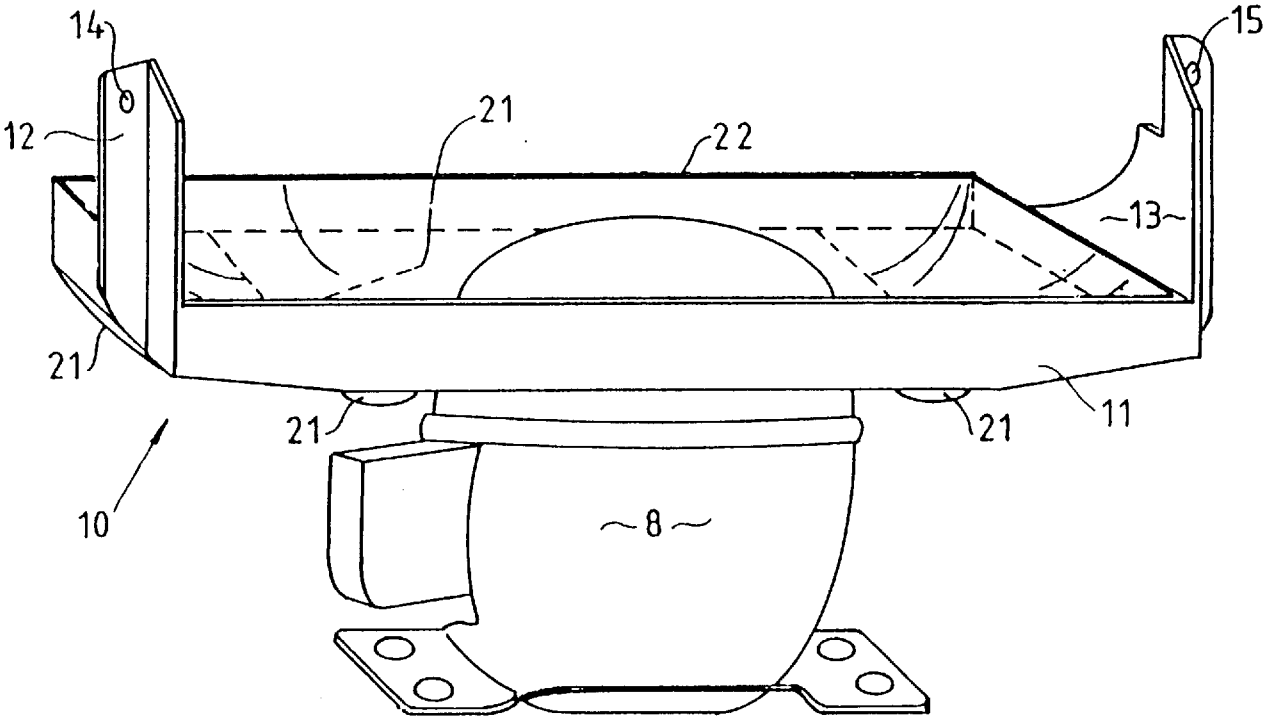
FIG. 5 is a perspective view of the evaporation tray of FIG. 1 in use atop a refrigeration system compressor.
Figure 6:
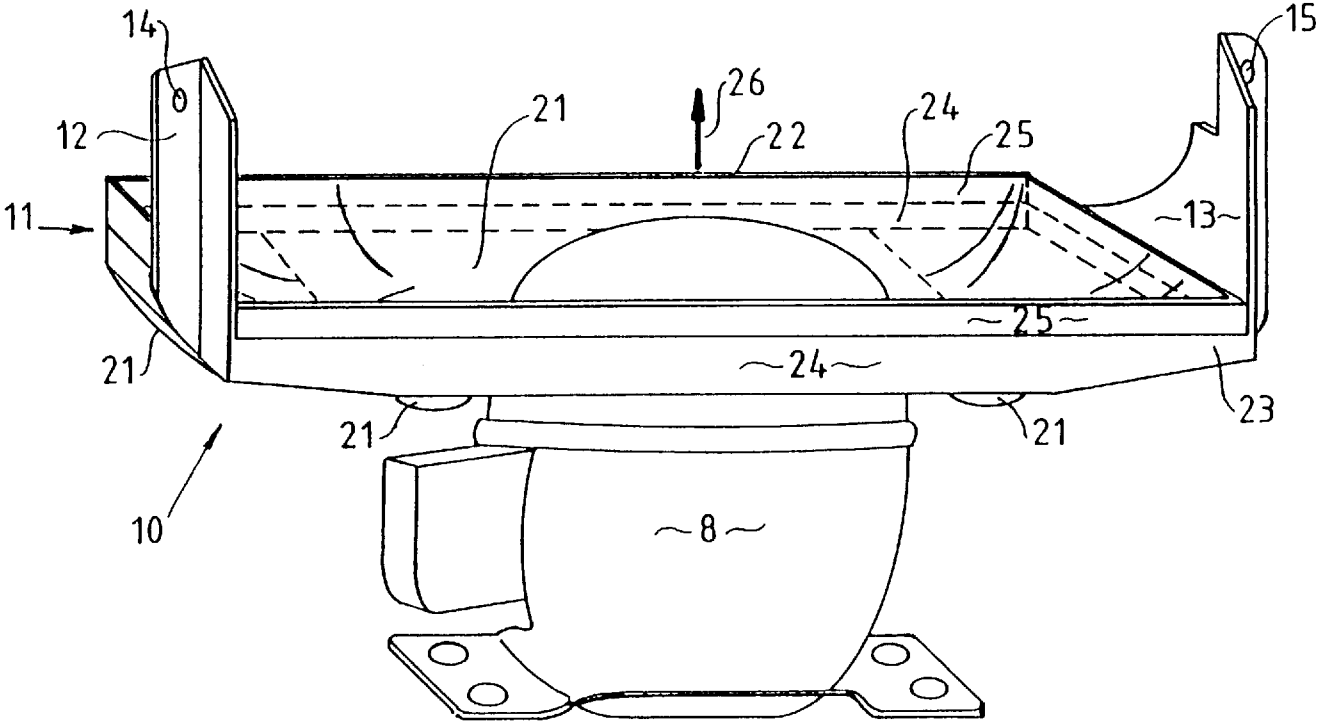
FIG. 6 is a perspective view of an alternative preferred embodiment of the evaporation tray shown in FIG. 5.

It can be seen in both of the embodiments shown in FIGS. 5 and 6 that the working position of the evaporation tray according to the present invention is directly over the compressor 8 with part of the compressor protruding within box frame 11. In order to accommodate the part of the compressor protruding within evaporation tray 10, container membrane 21 deforms to the shape of the protruding part of compressor 8. In this way, heat generated by compressor 8 is efficiently transferred through the surface of the compressor housing protruding into tray 10, through container membrane 21 and into the defrost liquid collected in the membrane. As container membrane 21 is an easily deformed material, a large proportion of the surface area of the part of compressor 8 protruding into the tray will be in contact with container membrane 21, providing a highly efficient heat transfer mechanism. As defrost liquid is drained to the evaporation tray 10, the weight of defrost liquid supported by container membrane 21 helps to force the membrane against the protruding part of the compressor, regardless of the shape of the compressor. It is anticipated that the evaporation tray according to the present invention should hold a maximum of approximately 2 litres of defrost liquid. Alternatively, the evaporation tray could be positioned above part of condenser 17 with container membrane 21 in contact with at least part of the outer surface of condenser 17.

It has been found that there is no need to specially mould the container membrane to any special profile as its easily deformable property allows a high heat transfer to occur even through overlapping or "creased" areas in the membrane 21. However, the container membrane could be preformed to have a natural shape more similar to the top of the compressor housing to reduce the amount of creasing in the membrane.

Accordingly, at least in the preferred form, the present invention provides an improved evaporation tray which has a highly efficient and effective heat transfer mechanism. The present evaporation tray is also of a design which will allow it to be incorporated in refrigerators and or freezers of different sizes, unlike previous trays which aware suited to a specific model only. Due to the reduction of rigid material, the production costs of the present evaporator tray are also expected to be reduced. It is possible that, due to the increase in evaporation efficiency of the tray according to the present invention, the tray may be manufactured so as to take up (and contain) a smaller volume than previous trays and accordingly, the compressor space in the rear of the refrigerator or freezer could be reduced, allowing for an increase in the volume of the cooling compartments.

We claim:

1. Liquid collection and evaporation means for refrigeration equipment adapted to collect liquid produced during the operation of said refrigeration equipment, said refrigeration equipment having a heat producing means with a heated surface, said liquid collection and evaporation means comprising:

substantially rigid frame means adapted for positioning adjacent said heated surface and forming a peripheral support which defines at least the extremities of a substantially horizontal opening, and flexible tray forming membrane means suspended at its periphery from said peripheral support, enclosing the space below said opening, said membrane assuming a tray shape capable of holding at least a predetermined volume of said liquid and adapted to contact and deform to the shape of said heated surface to enable heat to pass there through to evaporate said liquid.

2. Liquid collection and evaporation means as claimed in claim 1 wherein said flexible tray forming membrane means is made from a thin polymeric sheet material which may easily deform to the shape of said heated surface, substantially ensuring a maximal level of heat transfer from said heat producing means to said liquid within said flexible tray forming membrane means.

3. Liquid collection and evaporation means as claimed in claim 1 wherein said substantially rigid frame means comprise a substantially rectangular box-like frame having two opposed upper and lower open ends, and said flexible tray forming membrane means is a substantially rectangular sheet of material the area of said flexible tray forming membrane means being greater than the area enclosed by said lower open end of said box-like frame.

4. Liquid collection and evaporation means as claimed in either claim 1 or claim 3 wherein said refrigeration equipment includes a cabinet means including an overhanging portion which overhangs said heated surface and said liquid collection and evaporation means is suspended from said overhanging portion of said cabinet means.

5. Refrigeration equipment comprising:

a refrigeration system which, when operational extracts heat from within said refrigeration equipment, including a heat producing means which upon energisation produces heat, said heat producing means having a surface which is heated by at least some of said heat produced by said heat producing means, cabinet means containing at least one cooling compartment which is cooled due to the operation of said refrigeration system, said at least one cooling compartment on occasion producing a liquid flow due to the operation of said refrigeration system, liquid channeling means which collect said liquid flow from within said at least one compartment and direct said liquid flow outside said at least one cooling compartment, said liquid channeling means having an outlet outside said compartment through which collected said liquid flow is directed and liquid collection and evaporation means having substantially rigid frame means adapted positioned adjacent said heated surface of said heat producing means and forming a peripheral support which defines at least the extremities of a substantially horizontal opening configured to receive liquid discharged from said outlet of said liquid channeling means, and flexible tray forming membrane means suspended at its periphery from said peripheral support, enclosing the space below said opening, said membrane assuming a tray shape capable of holding at least a predetermined volume of said liquid and adapted to contact and deform to the shape of said heated surface to enable heat to pass there through to evaporate said liquid.

6. Refrigeration equipment as claimed in claim 5 wherein said flexible tray forming membrane means is made from a thin polymeric sheet material which may easily deform to the shape of said heated surface, substantially ensuring a maximal level of heat transfer from said heat producing means to said liquid within said flexible tray forming membrane means.

7. Refrigeration equipment as claimed in claim 5 wherein said substantially rigid frame means comprise a substantially rectangular box-like frame having two opposed upper and lower open ends, and said flexible tray forming membrane means is a substantially rectangular sheet of material, the area of said flexible tray forming membrane means being greater than the area enclosed by said lower open end of said box-like frame.

8. Refrigeration equipment as claimed in either claim 5 or claim 7 wherein said cabinet means includes an overhanging portion which overhangs said heated surface and said liquid collection and evaporation means is suspended from said overhanging portion of said cabinet means.

9. Liquid collection and evaporation means for refrigeration equipment adapted to collect liquid produced during the operation of said refrigeration equipment, said refrigeration equipment having a heat producing means with a heated surface, said liquid collection and evaporation means comprising:

a first supporting frame means adapted for attachment to said refrigeration equipment adjacent said heat producing means, and a second interconnecting membrane supporting means removably supported on said first supporting frame means, said first supporting frame means and said second interconnecting membrane supporting means together forming a substantially rigid frame means, and a flexible tray forming membrane means suspended from said second interconnecting membrane supporting means, which forms a tray shape capable of holding at least a predetermined volume of said liquid and adapted to contact and deform to the shape of said heated surface to enable heat to pass there through to evaporate said liquid.

10. Liquid collection and evaporation means as claimed in claim 9 wherein said flexible tray forming membrane means is made from a thin polymeric sheet material which may easily deform to the shape of said heated surface, substantially ensuring a maximal level of heat transfer from said heat producing means to said liquid within said flexible tray forming membrane means.

11. Liquid collection and evaporation means as claimed in claim 9 wherein said substantially rigid frame means comprise a substantially rectangular box-like frame having two opposed upper and lower open ends, and said flexible tray forming membrane means is a substantially rectangular sheet of material, the area of said flexible tray forming membrane means being greater than the area enclosed by said lower open end of said box-like frame.

12. Liquid collection and evaporation means as claimed in either claim 9 or claim 11 wherein said refrigeration equipment includes a cabinet means including an overhanging portion which overhangs said heated surface and said liquid collection and evaporation means is suspended from said overhanging portion of said cabinet means.

13. Refrigeration equipment comprising:

a refrigeration system which, when operational extracts heat from within said refrigeration equipment, including a heat producing means which upon energisation produces heat, said heat producing means having a surface which is heated by at least some of said heat produced by said heat producing means, cabinet means containing at least one cooling compartment which is cooled due to the operation of said refrigeration system, said at least one cooling compartment on occasion producing a liquid flow due to the operation of said refrigeration system, liquid channeling means which collect said liquid flow from within said at least one compartment and direct said liquid flow outside said at least one cooling compartment, said liquid channeling means having an outlet outside said compartment through which collected said liquid flow is directed and liquid collection and evaporation means having a first supporting frame means adapted for attachment to said refrigeration equipment adjacent said heat producing means, and a second interconnecting membrane supporting means removably supported on said first supporting frame means, said first supporting frame means and said second interconnecting membrane supporting means together forming a substantially rigid frame, and a flexible tray forming membrane means suspended from said second interconnecting membrane supporting means, which forms a tray shape held in position by said second interconnecting membrane supporting means to receive liquid discharged from said outlet and capable of holding at least a predetermined volume of said liquid, said membrane means contacting said heated surface and conforming to the shape thereof to enable hat to pass there through to evaporate said liquid.

14. Refrigeration equipment as claimed in claim 13 wherein said flexible tray forming membrane means is made from a thin polymeric sheet material which may easily deform to the shape of said heated surface, substantially ensuring a maximal level of heat transfer from said heat producing means to said liquid within said flexible tray forming membrane means.

15. Refrigeration equipment as claimed in claim 13 wherein said substantially rigid frame means comprise a substantially rectangular box-like frame having two opposed upper and lower open ends, and said flexible tray forming membrane means is a substantially rectangular sheet of material, the area of said flexible tray forming membrane means being greater than the area enclosed by said lower open end of said box-like frame.

16. Refrigeration equipment as claimed in claim 13 or claim 15 wherein said cabinet means includes an overhanging portion which overhangs said heated surface and said liquid collection and evaporation means is suspended from said overhanging portion of said cabinet means.

* * * * *

UNITED STATES PATENT AND TRADEMARK OFFICE

CERTIFICATE OF CORRECTION

PATENT NO. : 5,881,566

DATED : March 16, 1999

INVENTOR(S) : Anthony John Shacklock and Keith Brookes Spong

It is certified that error appears in the above-identified patent and that said Letters Patent is hereby corrected as shown below:

Column 3, Line 6 "and" should be -- and forming a peripheral support which defines at least the extremities of a substantially horizontal opening configured to receive liquid discharged from said outlet of said liquid channeling means, and --

Column 3, Line 24 "A-A" should be -- 2-2 --

Column 4, Line 46 "hat" should be --heat --

Column 6, Line 12 "aware" should be -- were --

Column 8, Line 54 "hat" should be --heat --

Signed and Sealed this

Second Day of November, 1999

*Attest:*

Q. TODD DICKINSON

*Attesting Officer*

*Acting Commissioner of Patents and Trademarks*